US007478985B2

(12) United States Patent
Johnson et al.

(10) Patent No.: US 7,478,985 B2
(45) Date of Patent: Jan. 20, 2009

(54) LOCKING MEMBER FOR PALLET RAMP SAFETY RETAINERS

(75) Inventors: Kevin Duane Johnson, Cary, NC (US); Ivan Neil Liverman, Middlesex, NC (US); Eric Allen Stegner, Durham, NC (US); Robert William Stegner, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/972,155

(22) Filed: Jan. 10, 2008

(65) Prior Publication Data

US 2008/0107496 A1 May 8, 2008

Related U.S. Application Data

(62) Division of application No. 11/305,247, filed on Dec. 16, 2005, now Pat. No. 7,357,609.

(51) Int. Cl.
*B60P 7/08* (2006.01)

(52) U.S. Cl. ..... 410/94; 410/46; 410/121; 410/153; 108/55.1

(58) Field of Classification Search ..... 410/46, 410/77, 80, 94, 121, 129, 153; 108/55.1, 108/55.3; 248/346.03
See application file for complete search history.

(56) References Cited

U.S. PATENT DOCUMENTS 5,772,369 A * 6/1998 Lerman et al. ..... 410/96
6,524,040 B1 2/2003 Heil
7,357,609 B2 * 4/2008 Johnson et al. ..... 410/94

* cited by examiner

*Primary Examiner*—Stephen Gordon
(74) *Attorney, Agent, or Firm*—Duke W. Yee; Mark E. McBurney; Houda T. El-Jarrah

(57) ABSTRACT

A method and apparatus are disclosed for locking at least two safety retainers together. Each safety retainer has a pallet-attached base and a ramp-attached mating bracket. Each safety retainer includes a base and a bracket. Each bracket is coupled to a ramp that is can be removably attached to a pallet. Each base includes a retaining arm for locking the base to the bracket when the ramp is coupled to the pallet. A locking mechanism is capable of being temporarily coupled to a first retaining arm in a first safety retainer and a second retaining arm in a second safety retainer for locking the retaining arms together. The first and second retaining arms must operate as a single unit, and cannot be moved independently, when the locking mechanism is coupled to the first and second retaining arms. The first and second retaining arms operate independently as separate units when the locking mechanism is not coupled to the first and second retaining arms.

12 Claims, 8 Drawing Sheets

LOCKING MEMBER FOR PALLET RAMP SAFETY RETAINERS

This application is a divisional of application Ser. No. 11/305,247, filed Dec. 16, 2005, and now issued as U.S. Pat. No. 7,357,609.

BACKGROUND OF THE INVENTION

1. Field of the Invention

The present invention relates in general to the field of shipment packaging, and in particular to pallets. Still more particularly, the present invention relates to a locking member for locking at least two safety retainers together so that the safety retainers function as a single unit, where each safety retainer prevents an object from being unloaded from a pallet unless the pallet ramp to which the safety retainer is attached is properly positioned with and secured to the pallet.

2. Description of the Related Art

Large and heavy products, such as computer servers, are typically shipped to a customer on a pallet. Upon delivery, the shipment must be manually offloaded from the pallet. To prevent damage from being jarred by dropping the shipment off the edge of the pallet, which is typically several inches high, the shipment is slid off the pallet using a ramp. Consider, for example, the arrangement shown in FIG. 1A. A shipment 102 is shipped to a customer's site on a pallet 104, which is set on the ground 106. To avoid jarring damage that could result from simply sliding the shipment 102 off the right side of the pallet 104, a ramp 108 is secured by a latch 110 to the pallet 104, providing a slide on which the shipment 102 can be moved to the ground 106.

The system shown in FIG. 1A works safely as long as latch 110 securely attaches ramp 108 to pallet 104. However, if ramp 108 and pallet 104 are not properly aligned, latch 110 is not being properly aligned. The result is shown in FIG. 1B, which depicts the end result of ramp 108 falling to the ground 106 while supporting the load of shipment 102. Shipment 102 has thus fallen to the ground 106 from a distance that is the height of pallet 104. If shipment 102 is a fragile product, such as a populated computer server chassis, the fall will likely cause expensive, if not irreparable, damage to shipment 102.

BRIEF SUMMARY OF THE INVENTION

The method and apparatus of the illustrative embodiment of the present invention uses a locking mechanism to lock at least two safety retainers together so that the safety retainers operate together as one single unit. Each safety retainer has a pallet-attached base and a ramp-attached mating bracket. A first safety retainer includes a first base and a first bracket. The first bracket is coupled to a first ramp that can be removably attached to a pallet. The first base includes a first retaining arm for locking the first base to the first bracket when the first ramp is coupled to the pallet. A second safety retainer includes a second base and a second bracket. The second bracket is coupled to a second ramp that can be removably attached to the pallet. The second base includes a second retaining arm for locking the second base to the second bracket when the second ramp is coupled to the pallet. The locking mechanism is capable of being temporarily coupled to the first and retaining arms for locking the retaining arms together. The first and second retaining arms operate as a single unit during movement of the retaining arms when the locking mechanism is coupled to the first and second retaining arms.

The above, as well as additional purposes, features, and advantages of the present invention will become apparent in the following detailed written description.

BRIEF DESCRIPTION OF THE SEVERAL VIEWS OF THE DRAWINGS

The novel features believed characteristic of the invention are set forth in the appended claims. The invention itself, however, as well as a preferred mode of use, further purposes and advantages thereof, will best be understood by reference to the following detailed description of an illustrative embodiment when read in conjunction with the accompanying drawings, where:

DETAILED DESCRIPTION OF THE INVENTION

Figure 1A:
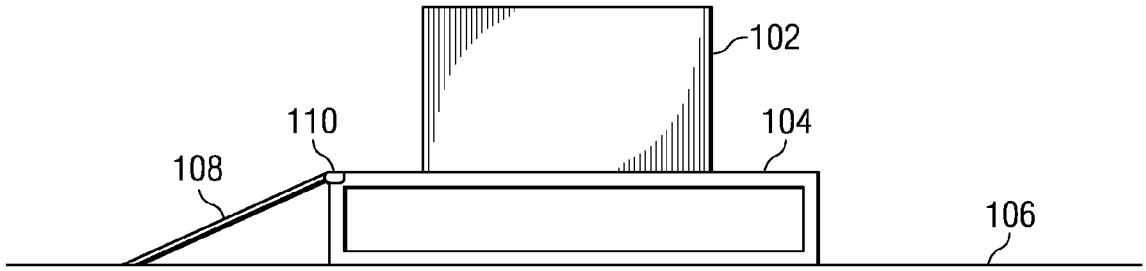
FIG. 1A (PRIOR ART)
FIGS. 1A-1B depict a prior art pallet and ramp system that is susceptible to latching failure due to misalignment of the pallet and ramp.
Figure 1B:
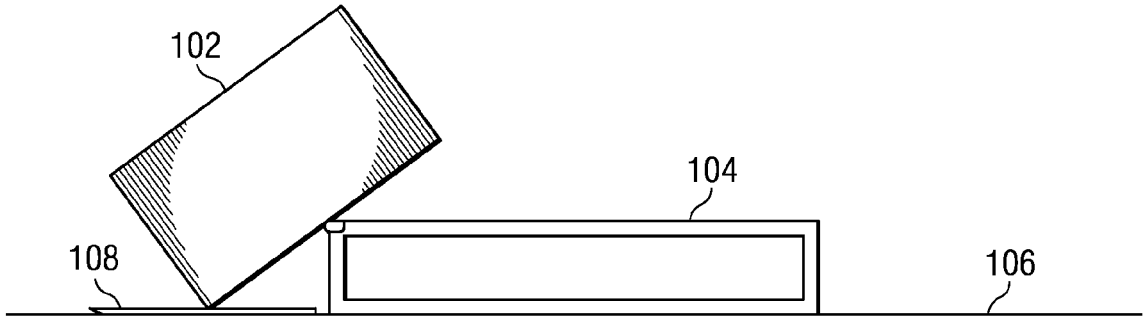
FIG. 1B (PRIOR ART)
Figure 2:
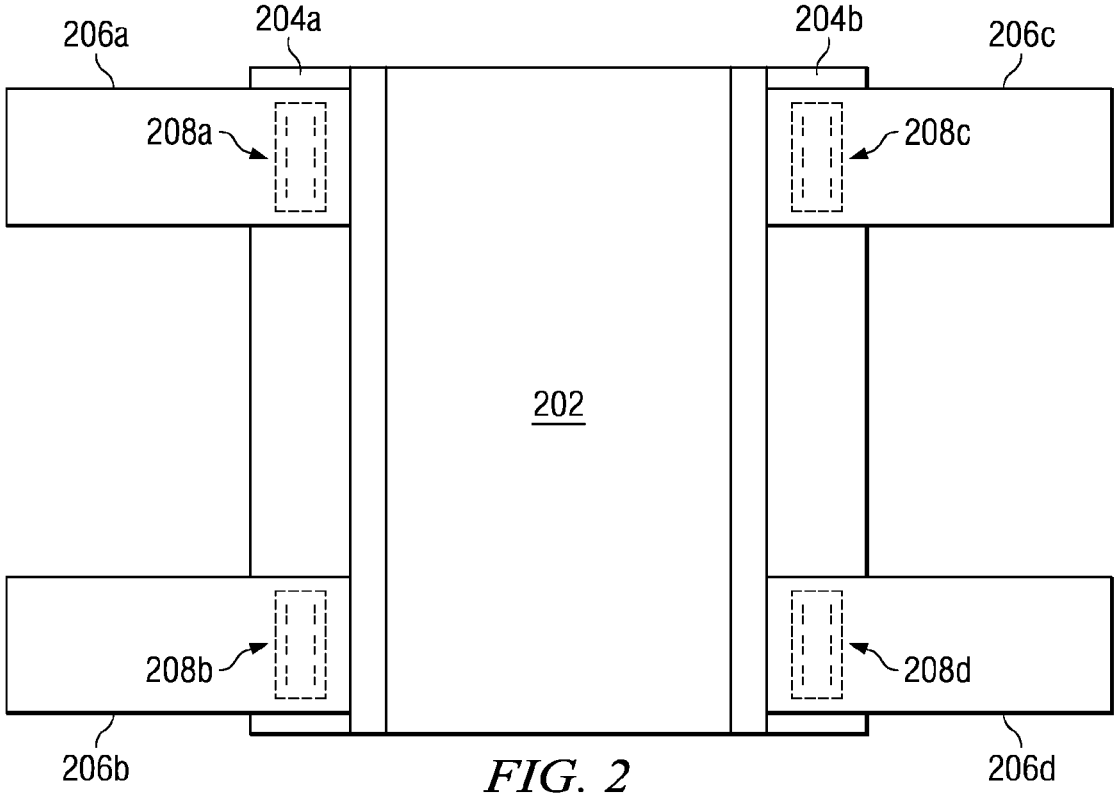
FIG. 2 illustrates a pallet and multiple ramp configuration as used in accordance with an illustrative embodiment of the present invention.

With reference now to FIG. 2, a top view of a pallet 202 is shown having beveled edges 204*a-b* at each end of pallet 202.

Four ramps 206*a-d* are attached to respective beveled edges 204*a-b* using latching systems 208*a-d*. Thus, the ramps 206*a-d* reach the ground 302 as shown below in the partial side view of pallet 202 depicted in FIG. 3C.

Figure 3A:
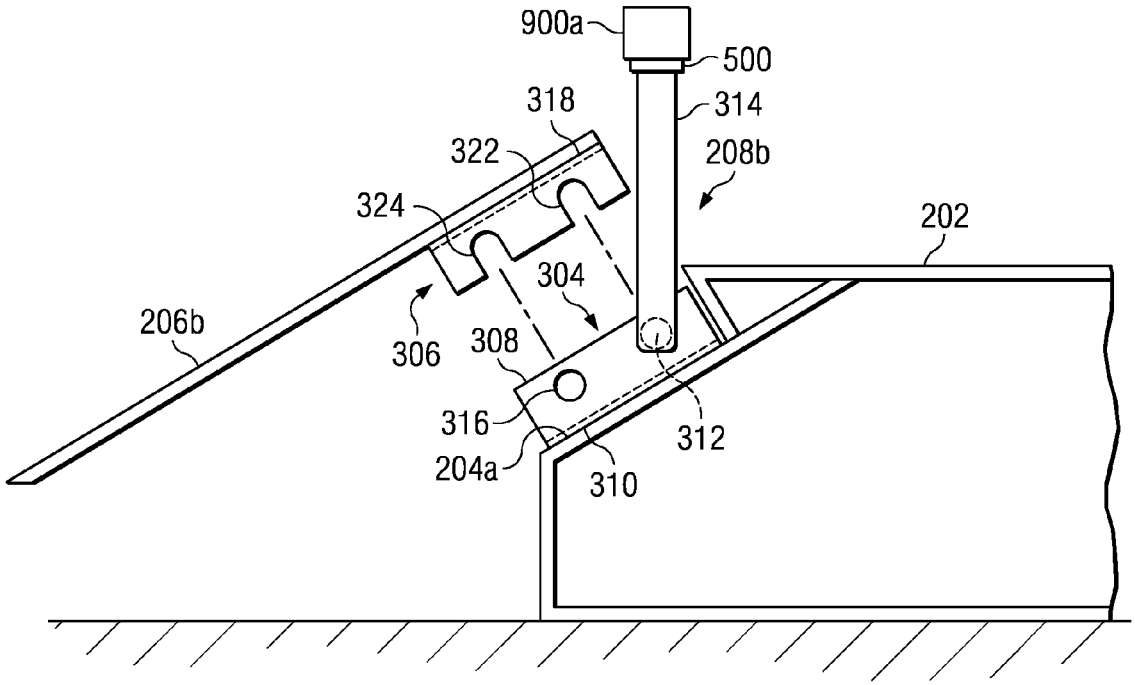
FIG. 3A depicts the inventive latching system before a base and mating bracket are mated in accordance with an illustrative embodiment of the present invention.

Referring now to FIG. 3A, a side view of pallet 202 and ramp 206*b* (which is representative of each of the ramps 206*a-d*) shows additional detail of latching system 208*b*. Latching system 208*b*, also called a safety retainer, which is representative of each of the latching systems 208*a-d* shown in FIG. 2, includes a base 304 and a mating bracket 306.

Base 304 includes a base bracket 308, which has a first base plate 310 that is directly attached to the upper surface of beveled edge 204*a*. Base 304 also has a first rod 312, a retainer arm 314, and a second rod 316, whose function is described in further detail below. Although first rod 312 and second rod 316 are depicted as cylindrical rods, it should be understood that their shape is not limited to cylindrical rods, but rather any rod having a geometry that permits first rod 312 to rotate as described below.

Figure 3B:
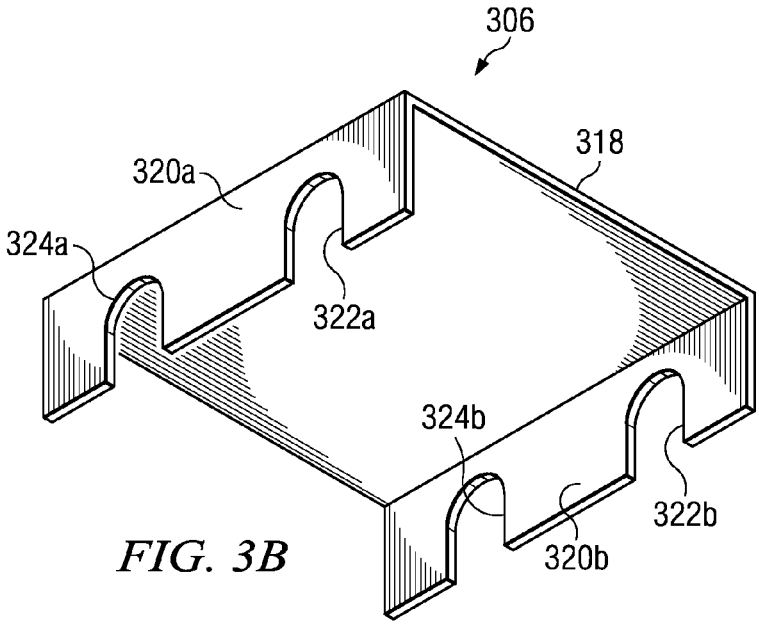
FIG. 3B illustrates additional detail of the mating bracket in accordance with an illustrative embodiment of the present invention.
Figure 3C:
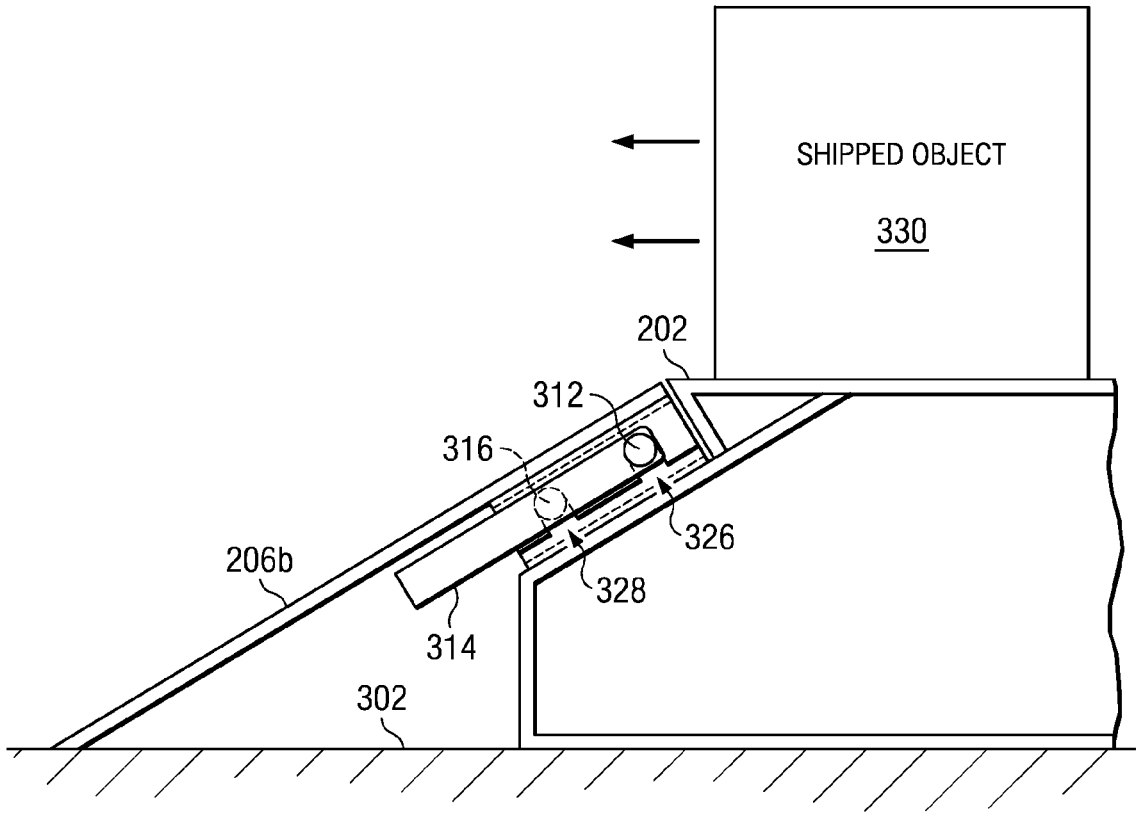
FIG. 3C depicts the latching system shown in FIG. 3A in a mated position in accordance with an illustrative embodiment of the present invention.

Mating bracket 306 has a second base plate 318 that is directly attached to the lower surface of ramp 206*b*. As shown in greater detail in FIG. 3B, mating bracket has a first slot plate 320*a* and a second slot plate 320*b* attached to second base plate 318. Each slot plate 320 has a first slot 322 and a second slot 324. As shown in FIG. 3C, first slot 322 has a first throat width 326, and second slot 324 has a second throat width 328. While first throat width 326 and second throat width 328 may be the same size or different sizes, first throat width 326 is wide enough to allow first slots 322 to mate with first rod 312, and second throat width 328 is wide enough to allow second slots 324 to mate with only a thin portion (discussed below) of second rod 316.

As shown in FIG. 3C, and as described in greater detail below, when second rod 316 is laterally slid within base 304 as described below, it no longer is able to block the rotation of retainer arm 314, which is thus able to fold downward, allowing a shipped object 330 on top of the pallet 202 to slide down ramps 206*a-b* shown in FIG. 2.

Figure 4A:
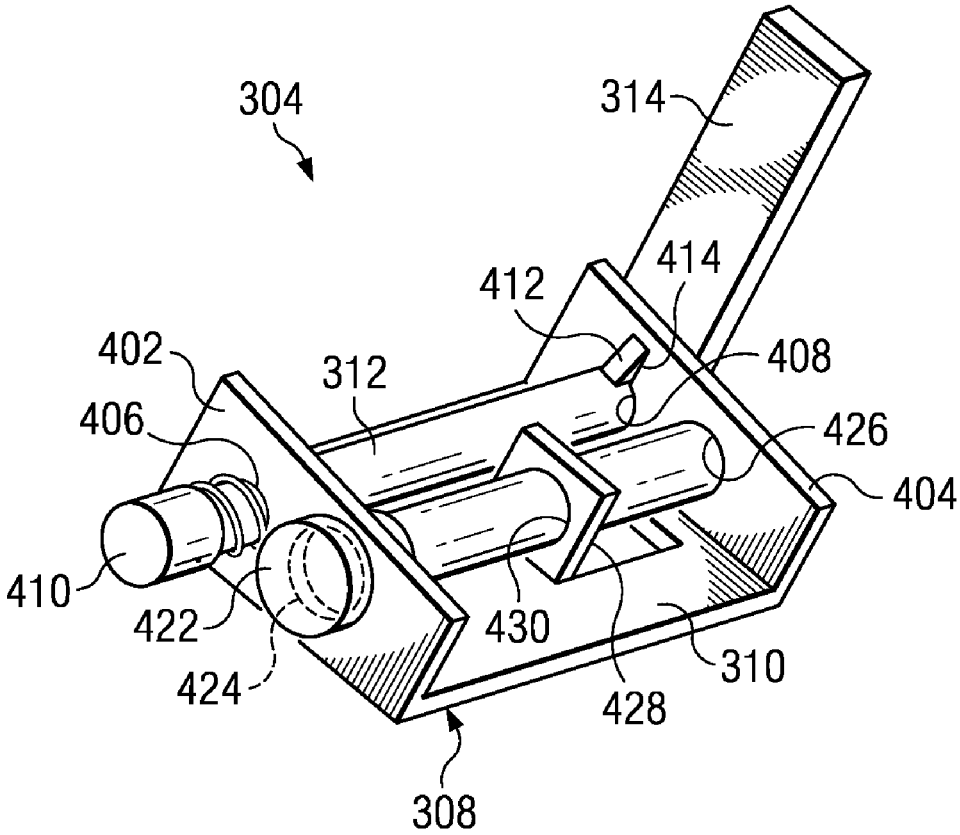
FIG. 4A illustrates, using two oblique views, additional detail of the base in which a retainer arm on a first rod is in a locked upright position by a second rod, thus preventing a shipment on the pallet from moving past the retaining arm in accordance with an illustrative embodiment of the present invention.
Figure 4A:
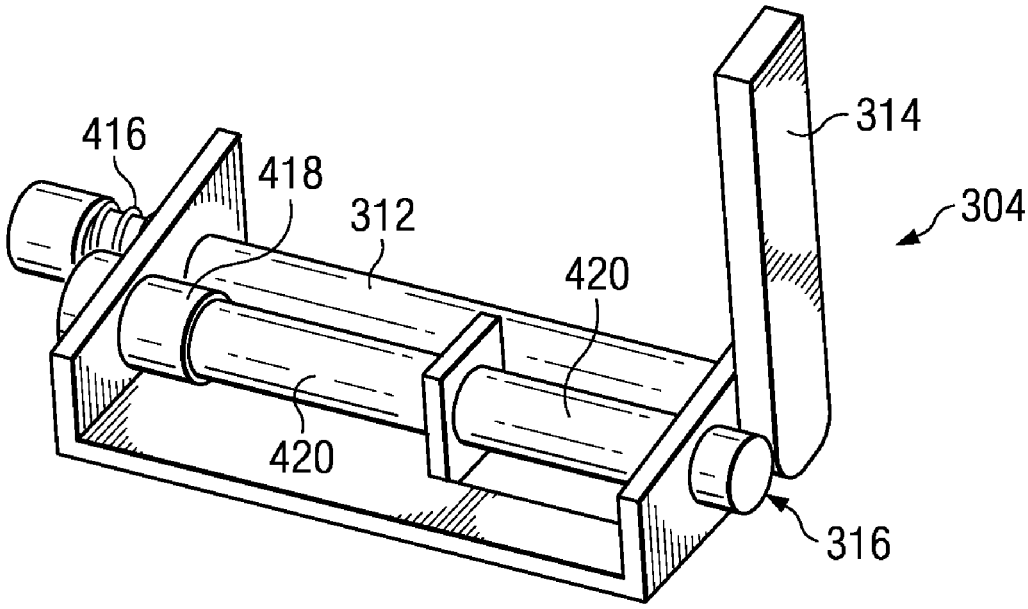

With reference now to FIG. 4A, additional detail is shown for base 304. For clarity's sake, pallet 202's beveled edge 204, to which base 304 is attached is not shown, nor is ramp 206 or its mating bracket 306. Mating bracket 306 and base 304 together make up latching system 208.

Base bracket 308 has a first side plate 402 and a second side plate 404 that extend away, preferably perpendicularly, from first base plate 310. A first end of first rod 312 extends through a first hole 406, and the second end of first rod 312, to which retainer arm 314 is attached, extends through a second hole 408. To keep first rod 312 from sliding past first hole 406, a first rod travel limiter 410 is part of the first end of first rod 312. First rod travel limiter 410 may be a collar as depicted, or may be any protrusion or projection of or from first rod 312 that limits the lateral movement of first rod 312 past first hole 406. Adequate space is provided between first rod travel limiter 410 and the exterior face of first side plate 402 to permit first rod 312 to move laterally to allow a retainer arm restrictor 412 to move clear of a restrictor slot 414, as shown below in FIG. 4C. Preferably, a first rod force lock 416, which is preferably a spring as shown, keeps retainer arm restrictor 412 within restrictor slot 414 by providing a force between first rod travel limiter 410 and the exterior face of first side plate 402. Alternatively, first rod force lock 416 may be a system of magnets, bands, other springs, or any other means for providing a lateral force to keep retainer arm restrictor 412 within restrictor slot 414, thus preventing first rod 312 from rotating and thus preventing retainer arm 314 from folding down.

Second rod 316 has a thick rod portion 418 and a thin rod portion 420. Thin rod portion 420 has a diameter that is small enough to mate with the second slots 324 of mating bracket 306, while thick rod portion 418 is too thick to pass through the second throat width 328 to mate with second slots 324 (all shown in FIGS. 3B-3C). The only way for mating bracket 306, including second slots 324, to mate with base 304 is to slide second rod 316 in the direction of knob 422, thus moving the thick rod portion 418 out of the way, allowing the thin rod portion 420 to mate into the second slots 324. Knob 422 serves as a convenient hold to pull second rod 316 to the side. In addition, in a preferred embodiment knob 422 is magnetized, thus keeping knob 422 against first side plate 402 until the ramp 206 (with its mating bracket 306) is properly aligned with base 304, and second rod 316 can be pulled to the side as described herein. Alternatively, any system of springs, counterweights, or other means for temporarily keeping knob 422 positioned against first side plate 402 may be used.

Thick rod portion 418 slides through a thick third hole 424 in first side plate 402, while thin rod portion 420 slides through a thinner fourth hole 426 in second side plate 404. Second rod 316 is aligned to slide into fourth hole 426 by an alignment bracket 428 having a fifth hole 430, preferably for aligning the thin rod portion 420 as shown.

Figure 4B:
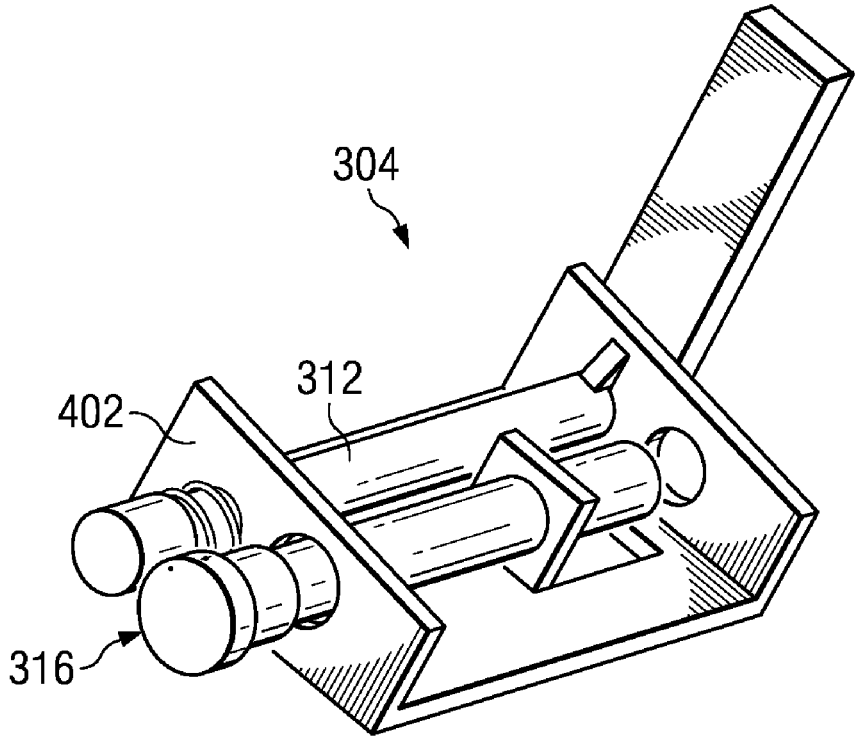
FIG. 4B depicts, using two oblique views, the base with the second rod moved laterally away from the retaining arm, such that the second rod no longer prevents the retaining arm from folding down in accordance with an illustrative embodiment of the present invention.
Figure 4B:
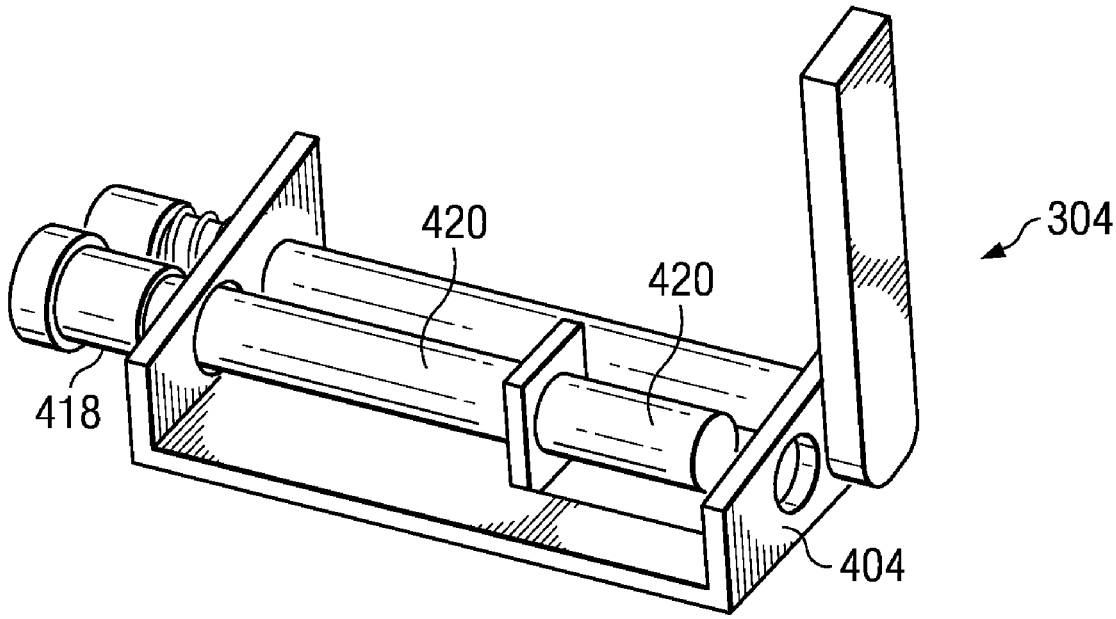

FIG. 4A thus depicts base 304 in a double-locked position, in which retainer arm 314 is prevented from folding down by both retainer arm restrictor 412 as well as by second rod 316 protruding past second side plate 404. Referring now to FIG. 4B, base 304 is depicted with second rod 316 having been pulled to one side such that the thick rod portion 418 is no longer between first side plate 402 and second side plate 404. In this position, mating bracket 306 (not shown) is able to mate its second slots 324 with thin rod portion 420 and its first slots 322 with first rod 312. By feeling this mating between mating bracket 306 and base 304 during the manual positioning of the ramp 206, the user is assured that ramp 206 is properly aligned with pallet 202 and its base 304. Second rod 316 is no longer outside second side plate 404, and thus second rod 316 no longer poses an impediment to a downward travel of retainer arm 314.

Figure 4C:
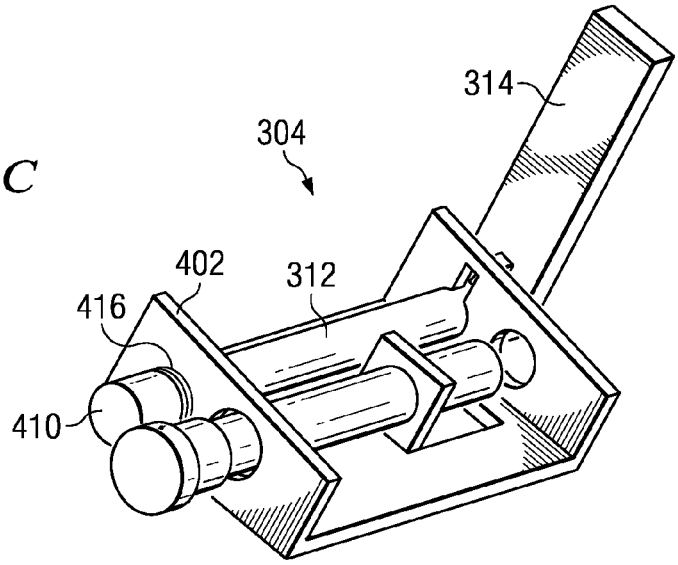
FIG. 4C illustrates, using two oblique and one side view of the base, the retaining arm in the base as being unrestricted by a chamfer that has been moved out of a restrictor slot in accordance with an illustrative embodiment of the present invention.
Figure 4C:
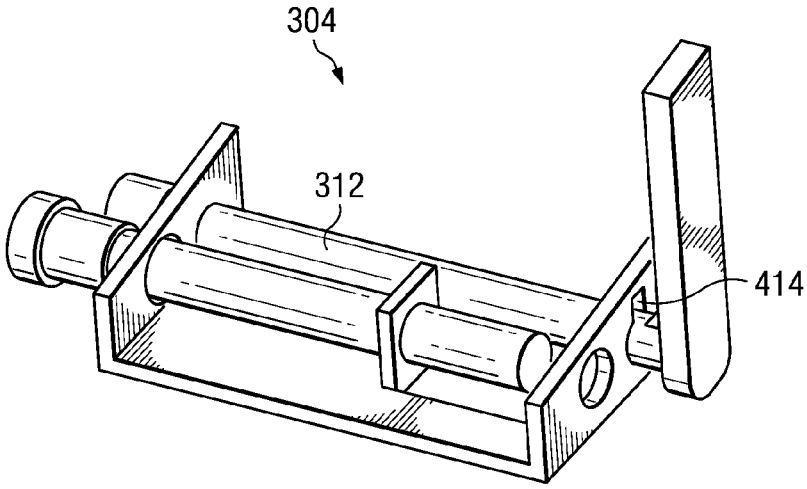
Figure 4C:
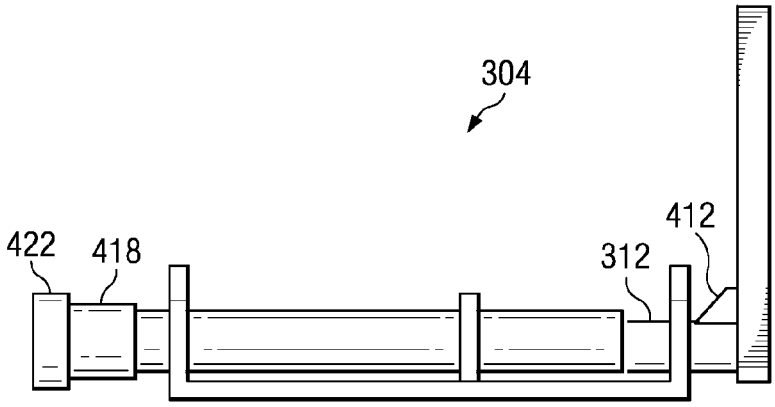
Figure 4D:
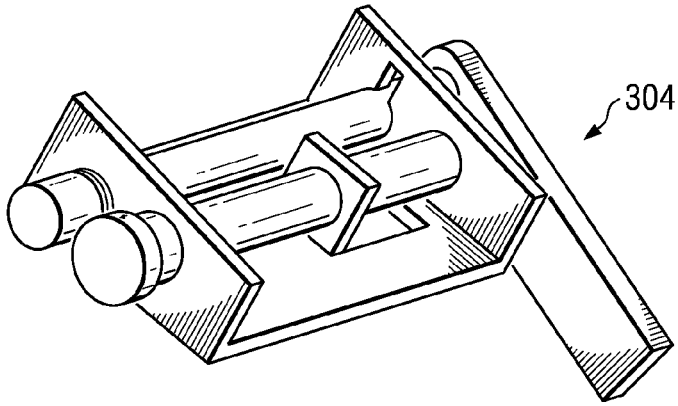
FIG. 4D depicts, using two oblique and one side view of the base, the retaining arm in a folded down unrestricting position, such as shown in FIG. 3*c* in accordance with an illustrative embodiment of the present invention.
Figure 4D:
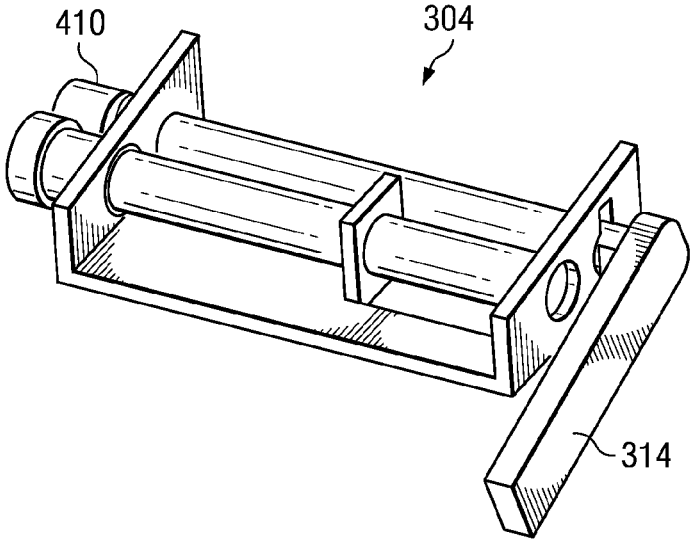
Figure 4D:
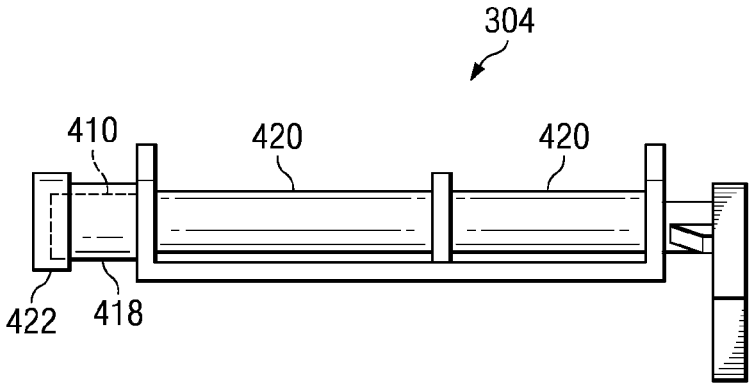

With reference now to FIG. 4C, assume that ramp 206 and mating bracket 306 (neither shown) are properly mated with base 304. First rod 312 is then pushed to the side until first rod travel limiter 410 hits against the first side plate 402, freeing retainer arm restrictor 412 from restrictor slot 414. First rod 312 is now free to rotate, allowing retainer arm 314 to fold downward, as shown in FIG. 4D and FIG. 3C. Since retainer arm 314 is no longer sticking upwards, object 330 is now free to slide towards and down ramp 206.

Figure 5:
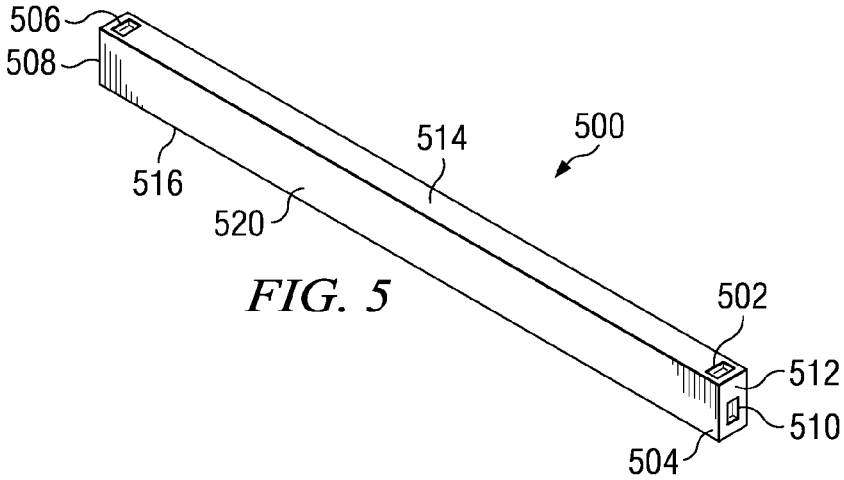
FIG. 5 is a perspective view of a locking member in accordance with the illustrative embodiment of the present invention.
Figure 8:
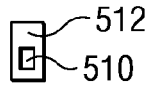
FIG. 8 is a side view of a locking member in accordance with the illustrative embodiment of the present invention.
Figure 6:
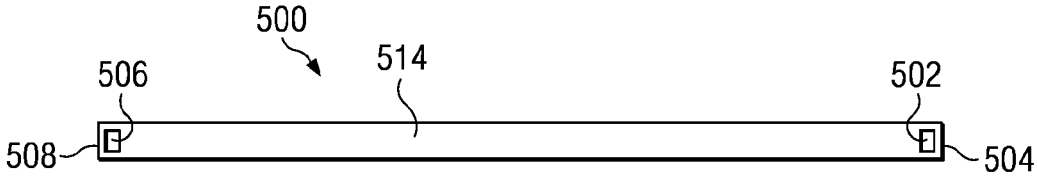
FIG. 6 is top view of a locking member in accordance with the illustrative embodiment of the present invention.
Figure 7:
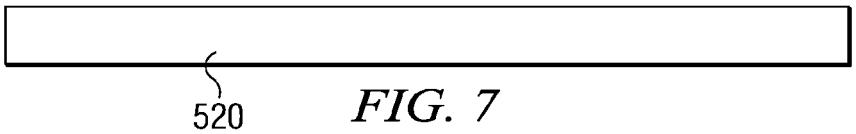
FIG. 7 is a front view of a locking member in accordance with the illustrative embodiment of the present invention.

FIG. 5 is a perspective view of a locking member 500 in accordance with the illustrative embodiment of the present invention. FIG. 6 is top view of a locking member in accordance with the illustrative embodiment of the present invention. FIG. 7 is a front view of a locking member in accordance with the illustrative embodiment of the present invention. FIG. 8 is a right side view of a locking member in accordance with the illustrative embodiment of the present invention.

In the illustrative embodiment, locking member 500 is rectangular although any other suitable shape can be used. Locking member 500 includes a first opening 502 through a first end 504 of locking member 500 and a second opening 506 through a second end 508 of locking member 500. First opening 502 is for receiving a retaining arm 314*a* of a first base 304*a*. Second opening 506 is for receiving a retaining arm 314*b* of a second base 304*b*. Locking member 500 includes an opening 510 in an end surface 512. Locking member 500 may also include another opening (not shown) in an opposite end surface. First opening 502 goes completely through locking member 500 from a top 514 through a bottom 516 of locking member 500. Second opening 506 goes completely through locking member 500 from a top 514 through a bottom 516 of locking member 500. Locking member 500 includes a front 520.

A safety release, such as a button, may be provided utilizing opening 510 such that locking member 500 snaps into place when received by two retaining arms and cannot be removed from the retaining arms until the button is depressed through opening 510.

Figure 9:
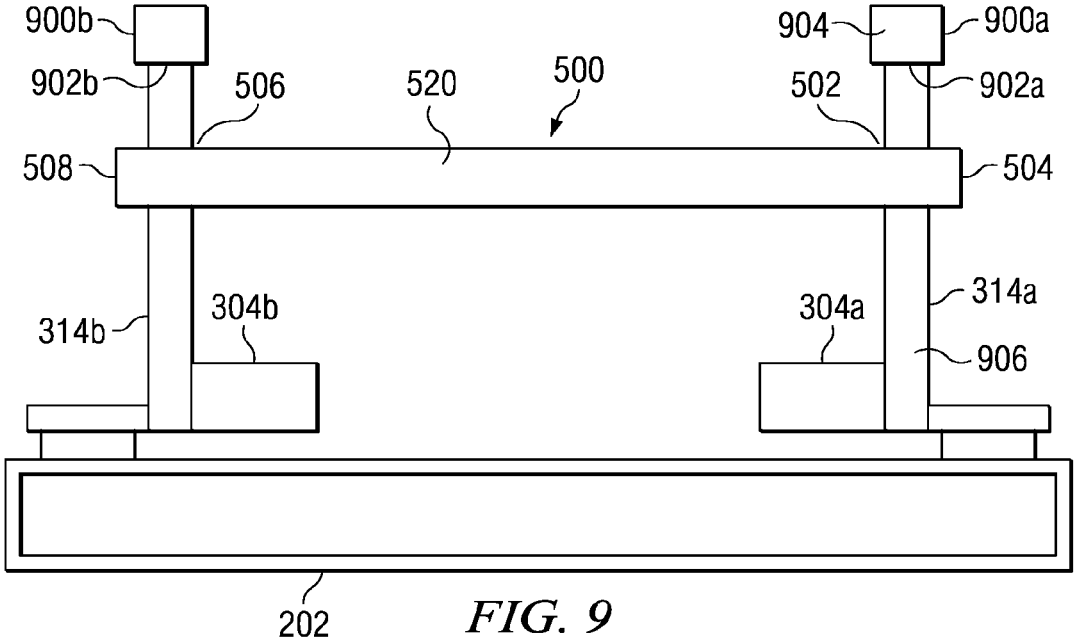
FIG. 9 is a front view of a locking member coupled to two retaining arms in accordance with the illustrative embodiment of the present invention.

FIG. 9 is a front view of a locking member coupled to two retaining arms in accordance with the illustrative embodiment of the present invention. Locking member 500 is utilized to temporarily couple arm 314*a* and arm 314*b* so that arms 314*a*, 314*b* cannot be actuated separately. In this manner, arms 314*a* and 314*b* cannot be moved separately. Arms 314*a* and 314*b* move together as one unit when locking member 500 is lowered over arms 314*a* and 314*b* as depicted in FIG. 9.

As described above, a safety retainer includes a base and a bracket. The bracket is coupled to a ramp that is removably attached to a pallet. The base includes a retaining arm for locking the base to the bracket when the ramp is removably coupled to the pallet. The illustrative embodiment is a locking member for locking retaining arm 314*a* of a first safety retainer to retaining arm 314*b* of a second safety retainer. Locking member 500 is capable of being temporarily coupled to both retaining arms 314*a*, 314*b* for locking retaining arms 314*a*, 314*b* together to prevent either arm 314*a* or arm 314*b* from being able to be moved separately from the other retaining arm. When locking member 500 is lowered over arms 314*a* and 314*b*, both ramps, i.e. the ramps that are attached to the safety retainers that include arms 314*a* and 314*b*, must be properly installed on the pallet before retainer arms 314*a* and 314*b* can be moved.

An additional brace, such as brace 900*a* and/or brace 900*b*, may be utilized to further support and protect packages or server racks that are installed on the pallet. Brace 900*a* slides over a top 902*a* of arm 314*a*. Brace 900*b* slides over a top 902*b* of arm 314*b*. Brace 900*a*, 900*b* provides a surface area 904 that is larger than surface area 906 of the retaining arm. The larger surface area provides additional support to the products on pallet 202. The braces are for stabilizing products that rest on the pallet.

The present invention is thus a great safety improvement. Shipped objects are not able to be slid off a pallet until both ramps have been properly installed on the pallet, and the retainer arms, locked together using the locking member, are folded down. The retaining arms, locked together using the locking member, can be folded down only when the ramps, to which the retaining arms are coupled, are properly secured to the pallet.

The illustrative embodiment solves a safety issue found in the prior art and provides a safe and reliable way to remove both empty and configured server racks from their shipping pallets. The illustrative embodiment will not allow the rack to be removed unless both ramps have been properly installed on the pallet.

While the invention has been particularly shown and described with reference to a preferred embodiment, it will be understood by those skilled in the art that various changes in form and detail may be made therein without departing from the spirit and scope of the invention.

What is claimed is:

1. An apparatus for locking at least two safety retainers together, said apparatus comprising:

a first safety retainer having a first base and a first bracket;

said first bracket coupled to a first ramp that is removably attached to a pallet;

said first base including a first retaining arm for locking said first base to said first bracket when said first ramp is removably coupled to said pallet;

a second safety retainer having a second base and a second bracket;

said second bracket coupled to a second ramp that is removably attached to said pallet;

said second base including a second retaining arm for locking said second base to said second bracket when said second ramp is removably coupled to said pallet; and a locking mechanism capable of being temporarily coupled to said first retaining arm and said second retaining arm for locking said first retaining arm to said second retaining arm, said first retaining arm and said second retaining arm operating as separate units when said locking mechanism is not coupled to said first and second retaining arms and said first retaining arm and said second retaining arm operating as a single unit when said locking mechanism is coupled to said first and second retaining arms.

2. The apparatus according to claim 1, further comprising:

said locking mechanism including a first opening through a first end of said locking mechanism and a second opening through a second end of said locking mechanism, said first opening for receiving said first retaining arm and said second opening for receiving said second retaining arm.

3. The apparatus according to claim 1, further comprising:

a first brace temporarily coupled to a top of said first retaining arm after said locking mechanism has been temporarily coupled to said first and said second retaining arms for stabilizing products that rest on said pallet.

4. The apparatus according to claim 1, further comprising:

a first brace temporarily coupled to a top of said first retaining arm and a second brace temporarily coupled to a top of said second retaining arm after said locking mechanism has been temporarily coupled to said first and said second retaining arms, said first brace and said second brace for stabilizing products that rest on said pallet.

5. The apparatus according to claim 1, further comprising:

said locking mechanism being rectangular.

6. The apparatus according to claim 1, further comprising:

said locking mechanism including a third opening in an end surface of said locking mechanism for providing access to a safety release.

7. The apparatus according to claim 1, further comprising:

said first base composed of:

a base bracket composed of:

a first base plate;

a first side plate and a second side plate extending away from the first base plate, the first side plate having a first hole and a second hole, and the second side plate having a third hole and a fourth hole;

a first rod that includes:

said first retainer arm extending non-linearly away from the first rod, the first rod rotatably extending through the first hole in the first side plate of the first bracket and the third hole in the second side plate of the base bracket, and the first retainer arm being oriented by an external surface of the second side plate of the base bracket;

a second rod that includes:

a thin rod portion that has a first diameter;

a thick rod portion that is linear with the thin rod portion, the thick rod portion having a second diameter that is greater than the first diameter of the thin rod portion, wherein the thin rod portion is extensible through the fourth hole in the second side plate, and the thick rod portion is extensible through the second hole of the first side plate; and said first bracket being a mating bracket composed of:

a second base plate;

a first slot plate and a second slot plate extending away from the second base plate, the first and second slot plates each having a first slot and a second slot, wherein the first slot has a first slot width and the second slot has a second slot width;

wherein the first slots each have a first throat width that permits the first rod to mate with the first slots, and wherein the second slots have a second throat width that permits only the thin rod portion of the second rod to mate with the second slots in the mating bracket.

8. The apparatus of claim 7, wherein if the second rod's thick rod portion is oriented with and unable to mate with the second slot of the second slot plate of the mating bracket, the second rod's thin rod portion extending past an exterior surface of the base bracket's second side plate, wherein the first retainer arm of the first rod is prevented from rotating past the second rod's thin rod portion.

9. The apparatus of claim 8, further comprising:

a second rod force lock that forces the second rod to be in a non-aligned position in which at least one of the second slot is unable to mate with the second rod and the first retainer arm is prevented from rotating past the second rod's thin rod portion.

10. The apparatus of claim 9, further comprising:

a first rod travel limiter on a first end of the first rod that is opposite a second end to which the first retainer arm is attached, the first rod travel limiter being oriented against an exterior side of the first side plate of the first base, wherein the first rod is prevented from sliding through the third hole in the second side plate to a distance that permits the first retainer arm to rotate past the thin rod portion when the second rod is in the non-aligned position.

11. The apparatus of claim 10, further comprising:

a retainer arm restrictor attached to the first retainer arm and the first rod;

a restrictor slot in the second side plate of the first base; and a first rod force lock oriented between the first rod travel limiter and the exterior side of the first side plate of the first base, wherein the first rod force lock must be overcome with a lateral force to allow the retainer arm restrictor to be clear of the restrictor slot to permit a rotation of the first retainer arm.

12. The apparatus of claim 11, further comprising:

an alignment bracket extending from the first base bracket of the base, the alignment bracket having a fifth hole through which the thin rod portion of the second rod can traverse through and rotate within.

* * * * *